US006827511B2

(12) United States Patent
Uchikata

(10) Patent No.: US 6,827,511 B2
(45) Date of Patent: Dec. 7, 2004

(54) PRINTING APPARATUS AND CARRIAGE SCAN DRIVING METHOD

(75) Inventor: Yoshio Uchikata, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 13 days.

(21) Appl. No.: 09/769,323

(22) Filed: Jan. 26, 2001

(65) Prior Publication Data

US 2001/0026722 A1 Oct. 4, 2001

(30) Foreign Application Priority Data

Jan. 26, 2000 (JP) ..... 2000-017568

(51) Int. Cl.[7] ..... B41J 11/42
(52) U.S. Cl. ..... 400/283; 400/582
(58) Field of Search ..... 400/283, 279, 400/582, 578, 314

(56) References Cited

U.S. PATENT DOCUMENTS 4,976,555 A * 12/1990 Ueyama ..... 400/314.1
5,116,149 A 5/1992 Yamasaki ..... 400/314.1
5,788,383 A * 8/1998 Harada et al. ..... 400/185
6,076,911 A * 6/2000 Watanabe ..... 347/16

FOREIGN PATENT DOCUMENTS

JP 1-101173 4/1989
JP 02137955 A * 5/1990 ..... 400/582

* cited by examiner

*Primary Examiner*—Charles H. Nolan, Jr.
(74) *Attorney, Agent, or Firm*—Fitzpatrick, Cella, Harper & Scinto

(57) ABSTRACT

A carriage scanning period required for moving from completion position of printing of the preceding line to start position of printing of the next line is compared to a printing medium feeding period required for feeding a printing medium in a predetermined amount after printing in the preceding line. The carriage is temporarily decelerated and stopped after printing of the preceding line and maintained the carriage in stand-by state for a predetermined period so that scanning of carriage to the start position of printing of the next line after printing of the preceding line and feeding the printing medium for a predetermined amount are simultaneously completed when the carriage scanning period is less than the printing medium feeding period. The carriage is accelerated to reach the start position of printing of the next line at a predetermined speed. Thus, respective printing pattern can be printed at the minimum printing period.

25 Claims, 10 Drawing Sheets

PRINTING APPARATUS AND CARRIAGE SCAN DRIVING METHOD

BACKGROUND OF THE INVENTION

1. Field of the Invention

The present invention relates to a printing apparatus and a carriage scan driving method. More particularly, the invention relates to a serial type printing apparatus and a carriage scan driving method scanning a carriage in a direction perpendicular to a feeding direction of a printing medium.

2. Description of the Related Art

It is typical to gradually complete printing over an entire area of a printing medium by repeating a printing operation, in which printing is performed by scanning the carriage and performing printing by means of a printing head mounted on the carriage, and a feeding operation in which a printing medium is fed for a predetermined amount in a direction perpendicular to the scanning direction of the carriage.

Such serial type printing apparatus is controlled by scanning of the carriage so that a scanning distance of the carriage becomes the shortest, depending upon a printing region, in order to shorten a printing period.

Also, the carriage varies speed during an acceleration stage, constant speed stage, and deceleration stage during one scan, to perform printing at a constant speed condition and not to perform printing during the acceleration and deceleration stages. Therefore, it has been proposed to shorten the printing period by performing feeding of the printing medium during the acceleration and deceleration stages. For example, Japanese Patent Application Laid-Open No. 1-101173 (1989) has proposed a method to control an acceleration start timing of the carriage depending upon a period required for the feeding operation of the printing medium in order to certainly complete feeding of the printing medium by the completion of acceleration of the carriage.

However, printing regions are not always the same per line and can be long in one line and short in another. In the conventional method, a difference of the printing position due to a difference of the printing regions per line is not taken into account in scan-controlling of the carriage. Thus, the same control is applied for any lines, and whereby shortening of the printing period depending upon the difference of the printing region cannot be expected.

On the other hand, in the printing apparatus of an ink-jet printing system, it is required a certain period from ejection of an ink to hitting on the printing medium. Thus, the printing apparatus is required to effect correction of arrival time to the printing medium from ejection of the ink when scanning a carriage. Therefore, the printing apparatus can not shorten a printing period corresponding to that scanning period.

Furthermore, the ink jet-printing apparatus regularly performs a recovery operation even during a printing operation for the purpose of removing ink of increased viscosity by an ejecting operation for a plurality of times. However, in the conventional method, scan controlling of the carriage has not been performed when taking the period required for the recovery process into account to perform the same scan controlling in both the scan performing recovery operation and the scan not-performing recovery operation.

On the other hand, in not only the printing apparatus of the ink-jet printing system but also various bidirectional printing apparatuses in which the scanning direction of the carriage is different per line, namely the printing operation is performed in both the forward scan and the reverse scan, and it is required to make correction for deviation due to a scanning play of the carriage and a phase delay of the motor, or the like, by scan of the carriage. The shortening of the printing period cannot be achieved for the period required for correction as set forth above.

The present invention has been worked out in view of the problem set forth above. It is an object of the present invention to provide a printing apparatus and a carriage scan driving method in which printing can be performed in a shorter period per printing pattern.

SUMMARY OF THE INVENTION

A printing apparatus of the present invention scans a carriage mounting a printing head over a printing medium a plurality of times, to perform printing upon respective scan and to perform feeding the printing medium for a predetermined amount in a direction different from a scanning direction of said carriage between scans of plurality of times for printing on a printing medium. The printing apparatus includes means for getting information relating to a printing medium feeding period required for feeding the printing medium for the predetermined amount after completion of printing in a preceding line in a preceding scan. The printing apparatus also includes means for setting a carriage scanning period required to start printing of the next line after completion of printing in said preceding line so as to be substantially equal to the printing medium feeding period depending upon the printing completion position of the preceding line and the printing start position of the next line. The printing apparatus further includes means for driving said carriage to scan depending upon a period set by said carriage scanning period setting means.

By such construction of the present invention, the carriage scanning period is set depending upon the printing completion position of the preceding line and the printing start position of the next line, which are different per printing pattern, and the carriage driving means drives the scanning of the carriage so that the scanning of carriage from the printing start position of the next line after completion of printing of the preceding line, and feeding of the printing medium in the predetermined amount, are completed simultaneously. Therefore, printing can be performed at a possible minimum period, depending on the respective printing pattern.

The above and other objects, features and advantages of the present invention will become more apparent from the following description of embodiments thereof taken in conjunction with the accompanying drawings.

DESCRIPTION OF THE PREFERRED EMBODIMENT

Preferred embodiments of the present invention will be explained in detail with reference to the drawings.

Figure 1:
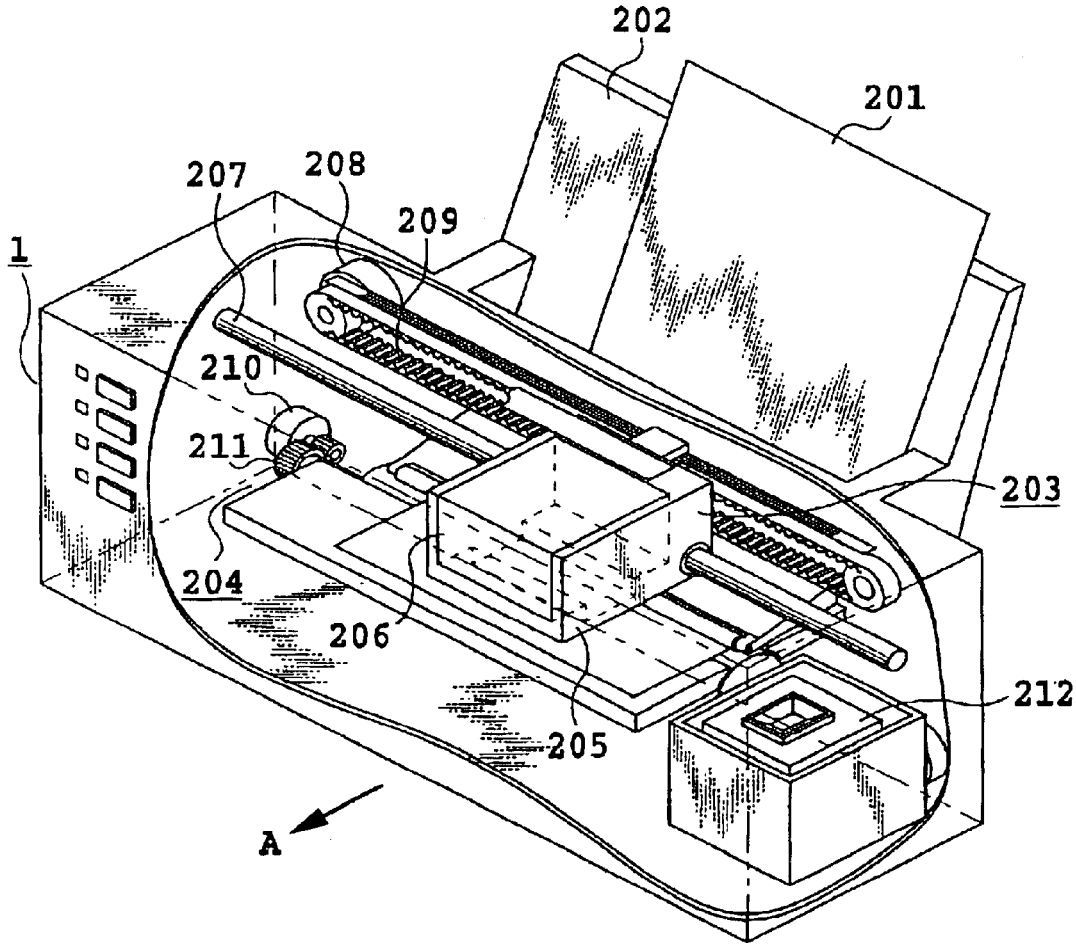
FIG. 1 is a perspective view of one embodiment of a printer according to the present invention.

FIG. 1 is a perspective view of one embodiment of a printer according to the present invention.

A printer 1 has a sheet feeder portion 202 feeding a printing medium 201 therefrom, a printing portion 203 performing printing for the fed printing medium 201 and a feeding portion 204 for feeding the printing medium 201.

The printing portion 203 has a carriage 205 mounting a printing head 206 (detail will be explained later). During printing, the carriage 205 performs a scan along a guide shaft 207. Upon scanning, an ink droplet is ejected from the printing head 206 toward the printing medium 201. The carriage 205 is driven by a driving force of a carriage motor 208 transmitted via a belt 209 thereto. Also, in principle, printing is bi-directional printing.

The feeding portion 204 has a feeding roller 211 that is driven by a feeding motor 210 to rotate for a given magnitude to transport the printing medium 201 for predetermined amount in a direction of arrow A. When the printing portion 203 performs one scan, the feeding portion 204 performs a feeding of the printing medium for the predetermined amount. By repeating printing and feeding, printing is performed over the entire area of the printing medium 201.

The printing head has a head portion, in which a plurality of ejection openings are arranged and ink tank portion, in which ink is stored. The head portion and the ink tank portion are communicated with a supply passage. A plurality of ejection openings are arranged in a direction perpendicular to the scanning direction of the carriage. Each of the ejection openings and the supply passages is communicated with ink passages to constantly fill the ink up to the ejection openings. On the other hand, corresponding to respective ejection openings, a heater as electro-thermal transducer, is provided. Upon ink ejection, the heater is heated to generate a bubble in the ink. By a pressure in generation of bubble, an ink droplet is ejected. In the shown embodiment, a bubble-jet type printing head is employed. However, the present invention is not limited to the bubble-jet type but is applicable for any type of printing methods. Furthermore, the present invention is not limited to the ink-jet system but is applicable for other printing methods, such as a thermal transfer type and the like.

A recovery processing portion 212 performs a preparatory ejection process for ejecting the ink from the nozzle of the printing head 206 in a region other than a printing region, a suction process for sucking the ink from the nozzle by a pump or the like, and a wiping process for cleaning the surface of the nozzle.

Figure 2:
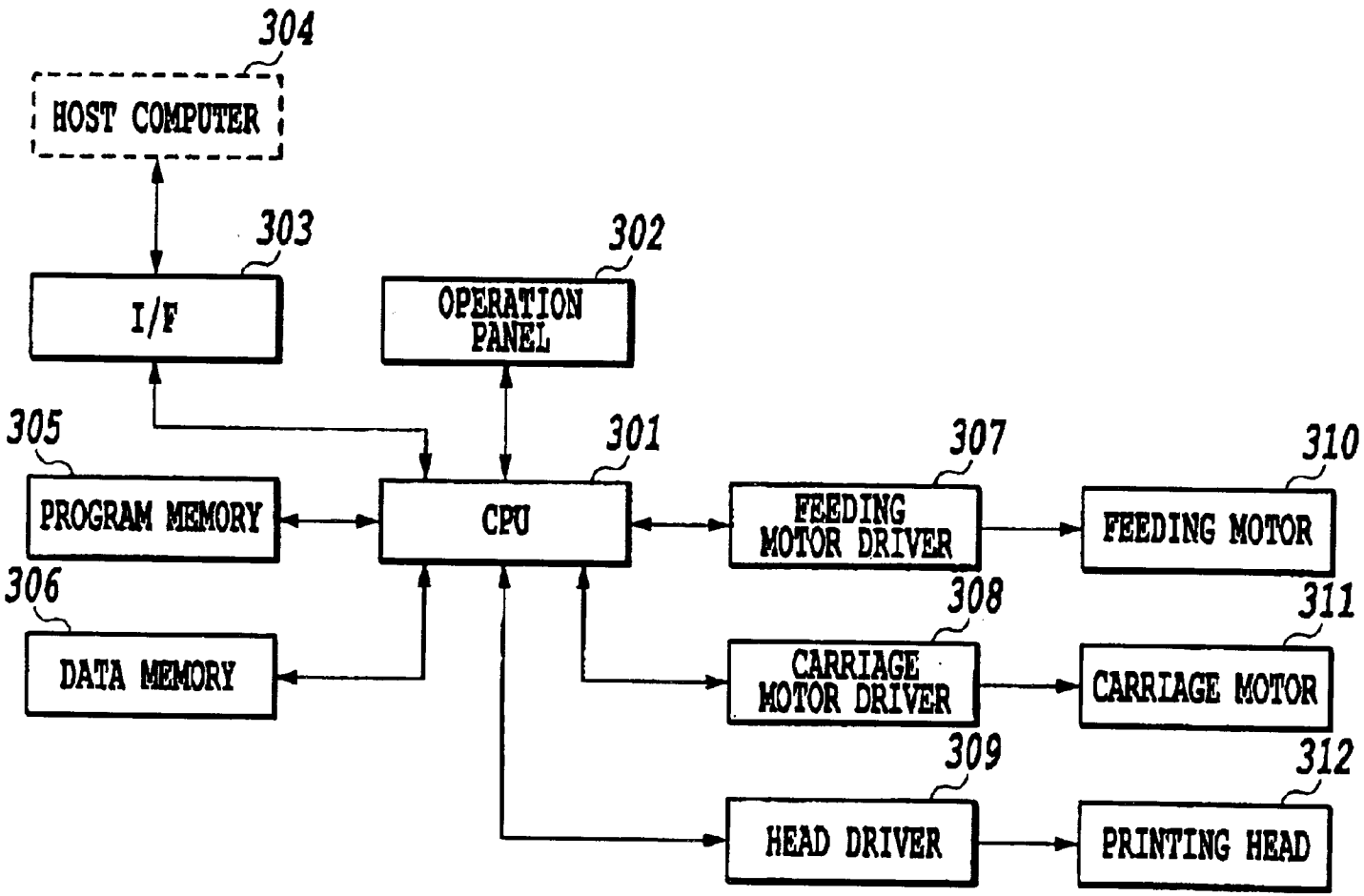
FIG. 2 is a block diagram showing a electrical construction of the printer.

FIG. 2 is a block diagram showing an electrical construction of the printer.

CPU 31 performs drive control of the respective driving portion of the printer. This is performed in response to an operation command input by a user through an operation panel 302 or a printing data or a printing command from a host computer 304 input through an interface portion (I/F) 303.

The driving of the respective driving portion is performed by a reading out program stored in a non-volatile program memory 305 and according to the read out program. On the other hand, a volatile data memory 306 temporarily stores record data transferred from the host computer 304 and is also used as a work memory during process.

Drive commands output from CPU 301 to respective driving portions are fed to the driving portions through a respective driver. The feeding motor 310 is driven according to a command from a feeding motor driver 307. The carriage motor 311 is driven according a command from a carriage motor driver 308. The printing head 312 is driven according to a command from a head driver 309.

Next, the drive control for the respective driving portion will be explained.

In the shown embodiment, depending upon the pattern to be printed, the driving from the completion of the preceding operation of the carriage to the start of the next scan is differentiated to control the scanning of the carriage so that the scanning distance of the carriage becomes minimal. Hereinafter, the driving method will be explained per printing pattern. It should be noted that the shown embodiment of the printer is designed to perform bi-directional printing as set forth above, and in general, for performing printing of the first line by a forward scan and printing of the second line by a reverse scan.

(1) Pattern 1: When Printing is Performed Over the Entire Printing Regions, Both in First and Second Lines.

Figure 3A:
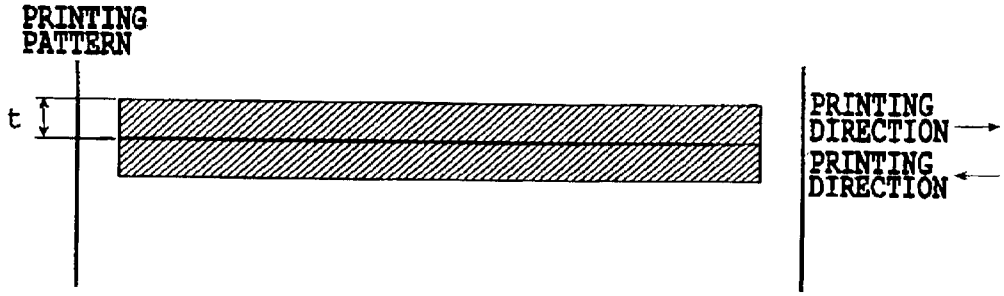
FIG. 3A is a diagrammatic chart showing a printing pattern 1.

A printing pattern shown in FIG. 3A shows the case where printing is to be performed over the entire printing regions both the forward scan (first line) and the reverse scan (second line). A printing width t in one scan corresponds to a width of ejection openings of the printing head.

Figure 3B:
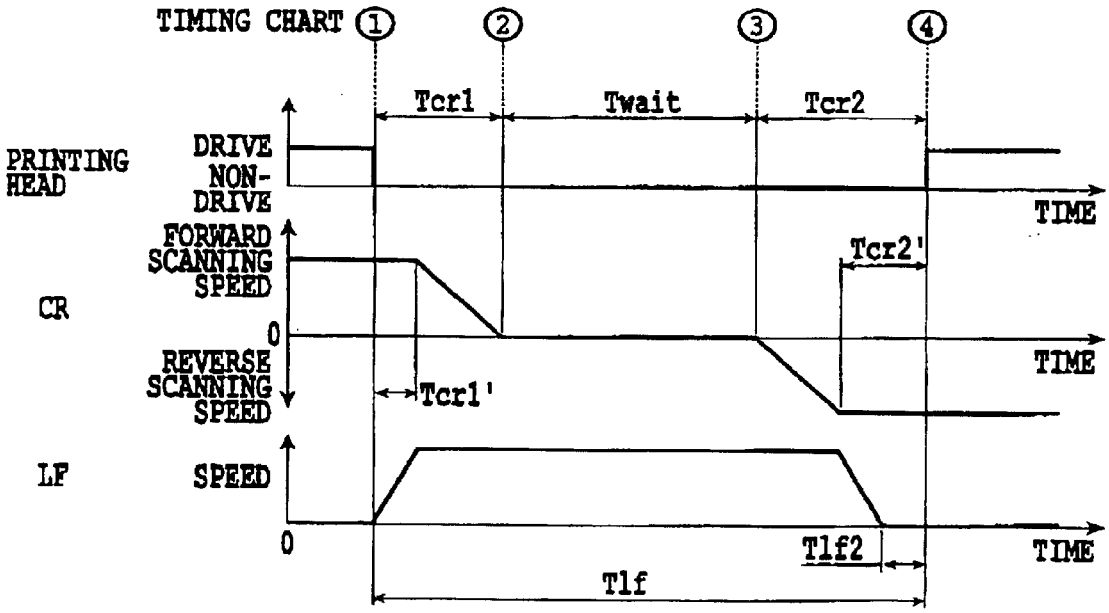
FIG. 3B is a timing chart showing operations of respective driving portions after printing for the first line of the printing pattern of FIG. 3A to starting printing for the second line.

FIG. 3B is a timing chart showing a behavior of the printing head, the carriage and the feeding motor upon transfer to printing of the second line after printing of the first line in the said printing pattern.

The timing chart of the printing head represents a driving condition of the printing head when the chart is present at an upper side and a non-driving condition of the printing head when the chart is present at a lower side.

The timing chart of the carriage (CR) shows a forward scanning speed by positive direction from 0 and a reverse scanning speed by a negative direction from 0. Speed 0 represents a resting condition of the carriage.

The timing chart of the feeding motor (LF) represents a feeding or feeding speed in a positive direction. Speed 0 represents a feeding stop condition.

A transfer operation from printing of the first line to printing of the second line will be explained with reference to the timing chart.

At the completion of printing in the forward direction, namely, when driving of the printing head is stopped (a point ① of FIG. 3B), the feeding motor is simultaneously driven. It should be noted that the drive timing of the feeding motor is preliminarily set depending upon a period required from ejection of the ink droplet to hitting on the printing medium. The feeding motor feeds the printing medium for a predetermined amount at a constant speed condition via an accelerating condition.

After termination of the driving of the printing head, the carriage is driven to travel while maintaining the current speed for a predetermined period Tcr1', and subsequently enters into a deceleration state to stop (at point ② of FIG. 3B). The reason to maintain the constant speed for the predetermined period Tcr1' is to adapt to a play of the carriage driving system or a phase delay of the motor, or, in the alternative, to correct the drive timing of the printing head depending upon the printing direction depending upon the arrival timing of the ink to the printing medium by driving of the printing head. It should be noted that such correction may be achieved not only by providing an extra period of constant speed driving but also by performing correction depending upon a scanning distance or position of the carriage. Also, in the shown embodiment, a constant speed state is maintained for the predetermined period Tcr1', when the value of Tcr1' is large, it is possible to accelerate during this period.

Next, after stopping for a waiting period Twait derived through a calculation discussed later (point ③ of FIG. 3B), the carriage is accelerated in the reverse direction. After the end of acceleration, the carriage is driven at a constant speed for a predetermined period Tcr2'. Thus, the carriage reaches the print start position (point ④ of FIG. 3B). Here, a period required from the completion of the printing of the first line to start printing of the second line (including the deceleration and stop period, acceleration period, waiting period and the preparatory ejection period and so forth) will be referred to as the "carriage scanning period". When the carriage reaches the print start position, the printing head starts a printing operation for the reverse direction. It should be noted that a period Tcr2', similar to Tcr1', is a period provided for compensation of the play of the carriage or the phase delay of the motor. These Tcr1' and Tcr2' periods are not necessarily provided at the end of the forward scan and before scanning in the reverse direction and can be either one for adjustment.

The feeding motor starts driving in response to the end of driving of the printing head for feeding the printing medium for a predetermined amount. However, after the driving of the feeding motor is terminated, the motor per se is still rotated due to an inertia force and the driving system is still maintained driving, or the feeding system, such as the feeding roller, is still acted on with inertia moment. Then a period T1f2 is required for completely stopping the printing medium. In practice, when a pulse motor is employed as the feeding motor, after driving the pulse motor for a predetermined number of pulses, the stopping of the feeding of the printing medium can be ensured by maintaining the finally excited phase for the period T1f2. On the other hand, when a DC motor is employed as the feeding motor, it becomes possible to certainly detect the stopping of the feeding of the printing medium by making a judgment of stopping of the vibration of the feeding roller by providing a sensor in a printing medium feeding path for detecting an angular position of the feeding roller, for example. Furthermore, when a driving force transmitting means is interposed between the feeding roller and the feeding motor, a difference of timing is caused from judgment of stopping by the sensor to stopping of the feeding roller as set forth above. Therefore, the stopping of feeding of the printing medium can be certainly performed by making the judgment of stopping of the printing medium after elapse of the predetermined period.

As set forth above, the period T1f is required for feeding the printing medium a predetermined amount, and an adjustment has to be made to place the carriage at a predetermined position within this period. This adjustment is done by adjusting a waiting period. Twait in which the carriage is held in the "stop" position. Hereinafter, a method for deriving Twait in the printing pattern of FIG. 3A will be explained.

At first, a period required for feeding the printing medium per one scan, namely a period T1f required from driving of the feeding motor to stopping of the printing medium (hereinafter referred to as "printing medium feeding period") is calculated. The printing medium feeding period is determined by a printing medium feeding amount depending upon the printing pattern.

Next, at every completion of one scan of the carriage, a deceleration stop period Tcr1, including the deceleration correction period Tcr1', is determined.

On the other hand, a carriage acceleration period Tcr2 including the acceleration correction period Tcr2' from the stopping of the carriage to starting of next scan is derived. With the value thus derived, Twait is derived.

It is assumed that when $T1f>Tcr1+Tcr2$, $Twait=T1f-(Tcr1+Tcr2)$, and when $T1f\leqq Tcr1+Tcr2$, $Twait=0$.

Namely, when $T1f>Tcr1+Tcr2$, the carriage scanning period becomes equal to the printing medium feeding period while providing the waiting period. On the other hand when $T1f\leqq Tcr1+Tcr2$, the carriage scanning period is adjusted to be as close as possible with setting the waiting period at 0. In this meaning, in either case, the carriage scanning period is substantially adjusted to be substantially equal with the printing medium feeding period.

Accordingly, when the carriage scanning period (Tcr1+Tcr2) from the completion of printing of the first line to starting of the printing of the second line is greater than the printing medium feeding period T1f, the carriage is driven for scanning with no waiting period (Twait). On the other hand, when the carriage scanning period from the completion of printing of the first line to starting of the printing of the second line (Tcr1+Tcr2) is smaller than the printing medium feeding period T1f, the waiting period (Twait) is provided between scanning of the carriage for the first line and the second line. Thus, immediately after the printing medium feeding period T1f is completed, the printing for the second line is initiated. Accordingly, the printing can be performed at a possible minimal time period irrespective of the printing pattern.

It should be noted that in the foregoing method, the waiting period (Twait) is derived on the basis of the carriage scanning period Tcr1 and Tcr2 and the printing medium feeding period T1f, which are predetermined. However, for example, when the carriage is operated by a DC motor servo-mechanism or the like, it is possible to cause individual differences in the carriage scanning period per the printing apparatus. In such a case, in deriving the period Tcr1 from completion of printing for the first line to stopping the carriage, it becomes possible to accurately calculate by measuring a period actually required for stopping the carriage after stopping driving of the motor and by using the actually measured period. And, concerning the carriage scanning period Tcr2 from acceleration of the carriage to starting of printing for the second line, the printing period can be shortened because printing for the second line is not initiated before stopping of feeding of the printing medium by using a period while taking an individual difference of the carriage scanning period into account.

As set forth above, even when the DC servo-mechanism is employed in the feeding motor, the printing period can be shortened because printing for the second line is not initiated before stopping the feeding of the printing medium by similarly using a period while taking an individual difference of the carriage scanning period into account.

Furthermore, by checking whether the printing medium is completely stopped or not at a timing of starting of printing for the second line, it may be possible to stop the printing operation when the printing medium is not stopped completely so as to avoid inappropriate printing;

(2) Pattern 2: When Print Start Position for the Second Line is Shifted for a Distance D The printing pattern of FIG. 4A is advanced to the print start position for the second line for a distance D from the print start position as illustrated in FIG. 3A.

Figure 4A:
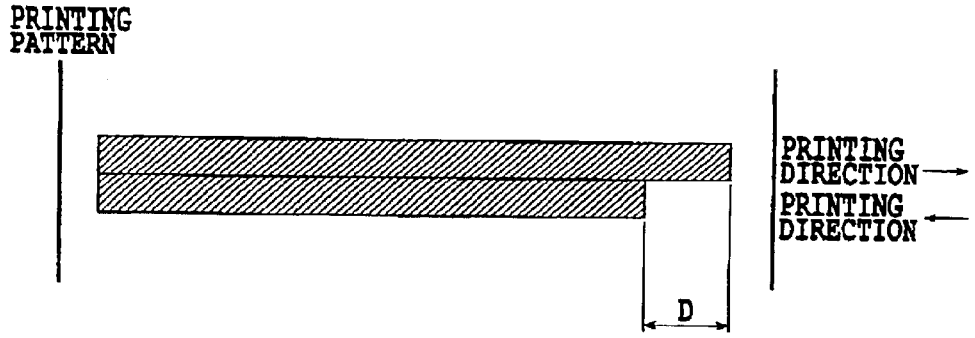
FIG. 4A is a diagrammatic chart showing a printing pattern 2.
Figure 4B:
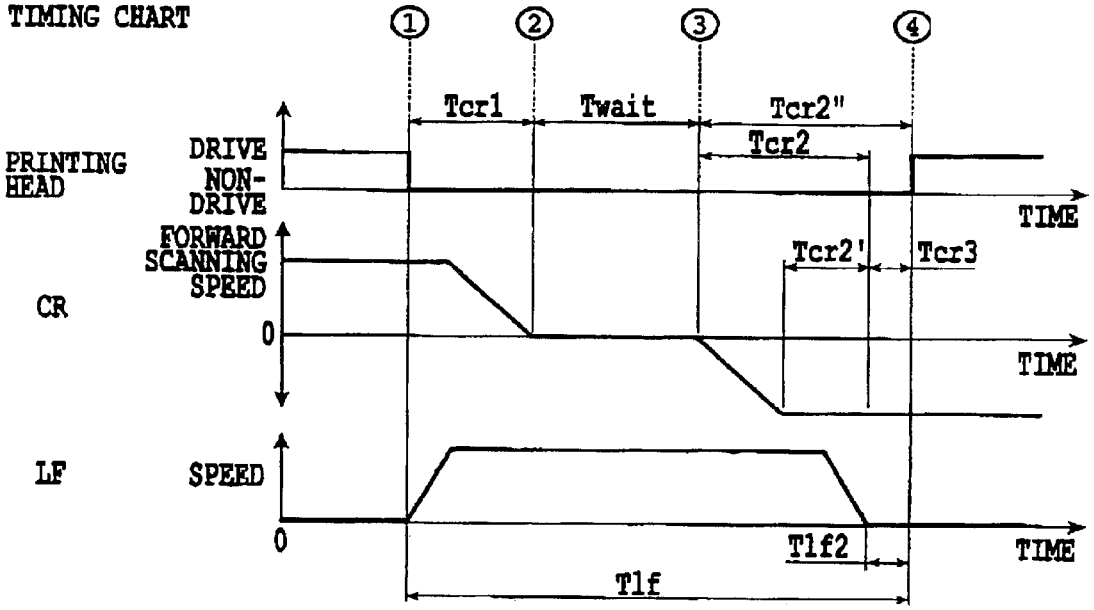
FIG. 4B is a timing chart showing operations of respective driving portions after printing for the first line of the printing pattern of FIG. 4A to starting printing for the second line.

FIG. 4B is a timing chart for printing the printing pattern of FIG. 4A.

The timing chart from completion of printing for the first line (point ① of FIG. 4B) to stopping the carriage (point ② of FIG. 4B) is the same as that of the pattern 1.

Since the feeding amount of the printing medium is similar to pattern 1, the driving of the feeding motor is similar to pattern 1.

Since the printing pattern 2 is advanced for the distance D in comparison with the printing pattern 1, the carriage is required to move for an extra length corresponding to the shifted distance before starting of driving of the printing head. Accordingly, a period Tcr2 required to place the carriage upon the printing start position for the second line becomes a sum of the carriage acceleration period Tcr2 (including the acceleration correction period Tcr2') and a period Tcr3 required for scanning the distance D at a constant speed.

Similarly to the pattern 1, Tcr1, Tcr2" and T1f are derived depending upon the printing medium feeding amount depending upon the performances of the feeding motor and the carriage motor and the printing pattern.

Then, when T1f>Tcr1+Tcr2", the waiting period (Twait) is derived by Twait=T1f−(Tcr1+Tcr2"). In case of T1f≦Tcr1+Tcr2", Twait=0.

As set forth above, by deriving the period Twait, the driving of the carriage is controlled according to the derived value. By this, in comparison with the pattern 1, the printing period can be shortened for the period of Tcr3.

On the other hand, when the first line is shorter than the second line in the extent of the distance D, a period from the print end timing for the first line (point ① of FIG. 4B) to the deceleration and stop point (point ② of FIG. 4B) becomes longer than that in the pattern 1 in the extent of Tcr3, and a period from the carriage acceleration start point (point ③ of FIG. 4B) to the print start timing for the second line ④ of FIG. 4B) becomes equal to that of the pattern 1. Therefore, even in this case, the printing period can be shortened for Tcr3 in comparison with the pattern 1.

(3) Pattern 3: When Printing Positions in the First Line and the Second Line do not Overlap with each Other (I)

Figure 5A:
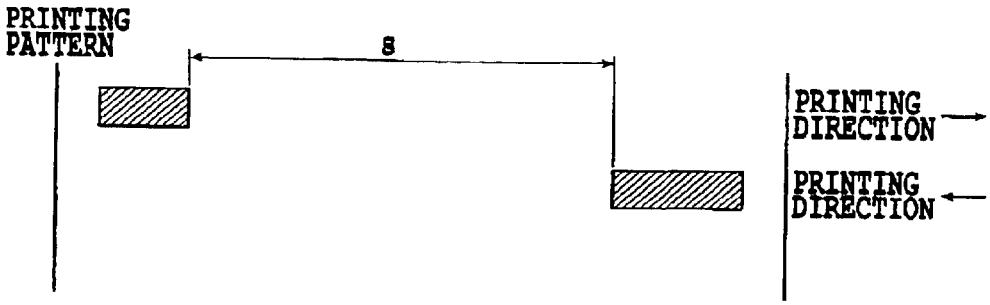
FIG. 5A is a diagrammatic chart showing a printing pattern 3.

The printing pattern of FIG. 5A does not have a portion where the printing positions in the first line and the second line are overlapping. In this case, without reversing the scanning direction of the carriage, two lines are printed in one scan. Furthermore, in the shown pattern, a distance s from the printing completion of the first line to the printing completion of the second line is long.

Figure 5B:
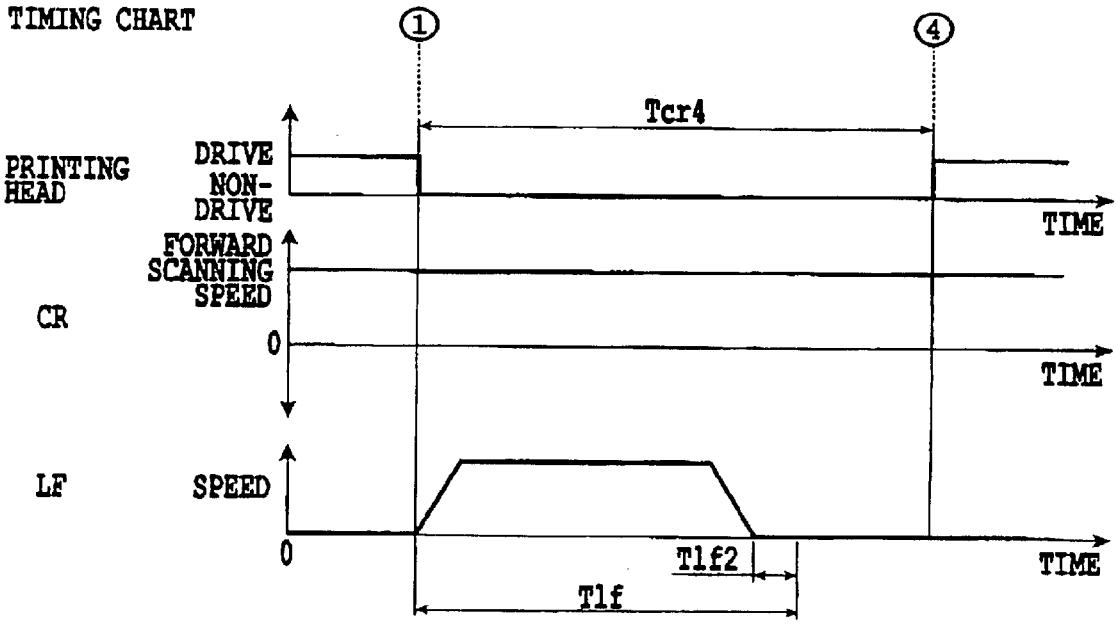
FIG. 5B is a timing chart showing operations of respective driving portions after printing for the first line of the printing pattern of FIG. 5A to starting printing for the second line.

FIG. 5B is a timing chart of the pattern 3.

A period Tcr4 required for scanning the distance s is derived. Then, the derived period Tcr4 is compared with the period T1f required for feeding the printing medium for one line. If T1f≦Tcr4, feeding of the printing medium can be completed while the carriage travels for the distance s. Accordingly, in such a printing pattern, after completion of printing of the first line (point ① of FIG. 5B), the carriage continues traveling without stopping to start printing of the second line.

It should be noted that while the carriage is driven to travel at a constant speed in the shown timing chart, a printing period can be further shortened by doubling the scanning speed within a range of T1f≦Tcr4.

(4) Pattern 4: when Printing Positions in the First Line and the Second Line does not Overlap with each Other (II)

Figure 6A:
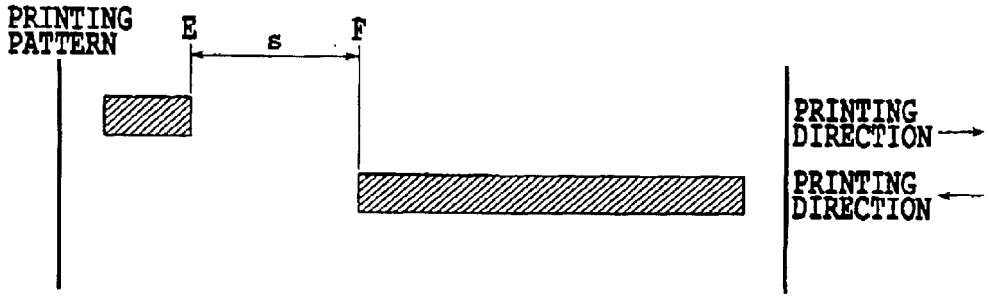
FIG. 6A is a diagrammatic chart showing a printing pattern 4.

The printing pattern of FIG. 6A does not have a portion where the printing positions in the first line and the second line are overlapping. In a manner similar to the pattern 3, without reversing the scanning direction of the carriage, two lines are printed in one scan. Furthermore, in the shown pattern, a distance s from the printing completion of the first line to the printing completion of the second line is relatively short.

Figure 6B:
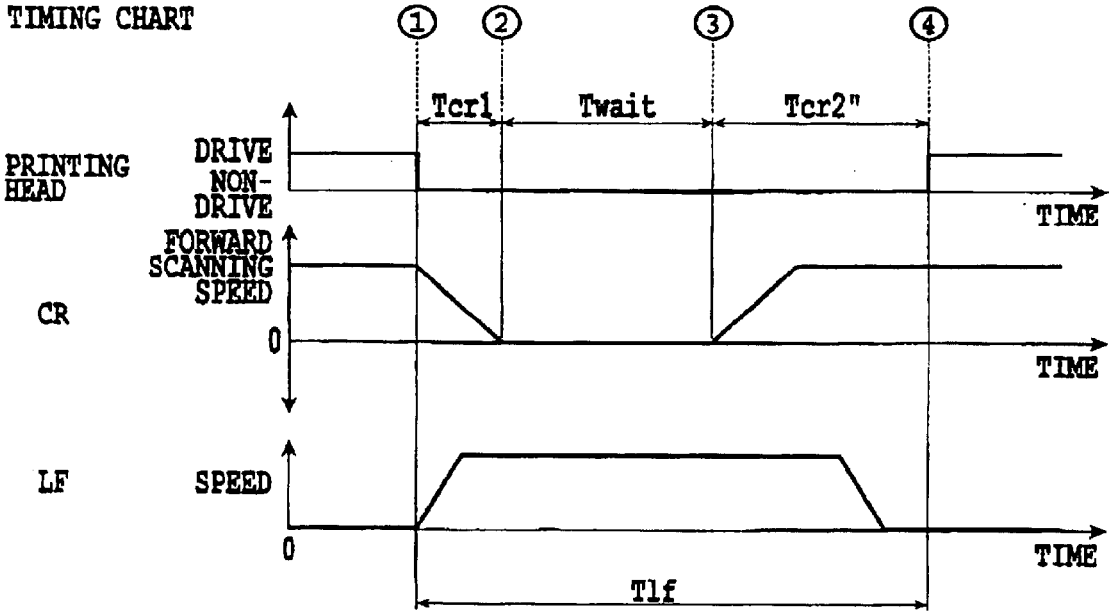
FIG. 6B is a timing chart showing operations of respective driving portions after printing for the first line of the printing pattern of FIG. 6A to starting printing for the second line.

FIG. 6B is a timing chart of the pattern 4.

A period Tcr4 required for scanning the distance s is derived. Then, the derived period Tcr4 is compared with the period T1f required for feeding the printing medium for one line. If T1f>Tcr4, feeding of the printing medium can not be completed while the carriage is completed to travel for a distance s. Therefore, the carriage travels to require the waiting period Twait until feeding of the printing medium is completed.

Therefore, after completion of printing of the first line (point ① of FIG. 6B), the carriage is once decelerated and stopped. It is assumed that the period required for stopping the carriage is Tcr5. It should be noted that, at this timing (point ② of FIG. 6B), the carriage is stopped at a point E of FIG. 6A. On the other hand, it is assumed that a period required for accelerating the carriage and reaching the printing start position of the second line (point F of FIG. 6A) is Tcr6.

On the other hand, after completion of printing of the first line, a period required for feeding the printing medium for the predetermined amount is T1f.

These T1f, Tcr5 and Tcr6 are calculated depending upon the printing medium feeding amount corresponding to the performances of the carriage motor and the feeding motor and the printing pattern.

Then, when T1f>Tcr5+Tcr6, Twait is calculated by Twait=T1f−(Tcr5+Tcr6). In the alternative, when T1f≦Tcr5+Tcr6, Twait is set as Twait=0.

By controlling the driving of the carriage depending upon the respective values thus calculated, a period required for printing can be shortened.

In the pattern 4, the timing chart of the mode where the carriage is stopped temporarily is described. However, in such a printing pattern, it is possible to take a mode where the carriage is decelerated to drive at a low speed without stopping.

Figure 7A:
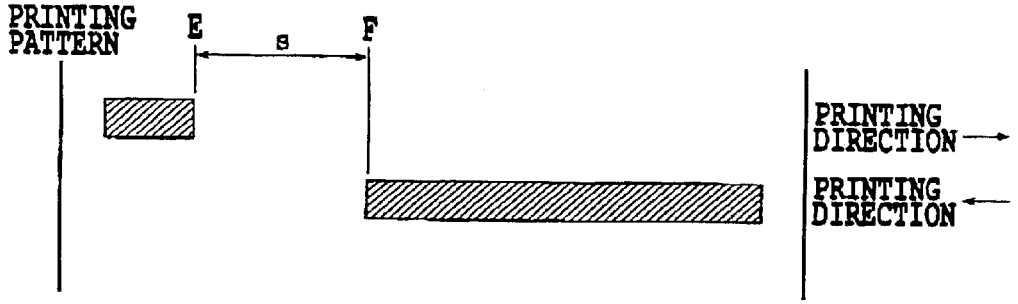
FIG. 7A is a diagrammatic chart showing a printing pattern 2 similar to FIG. 6A.
Figure 7B:
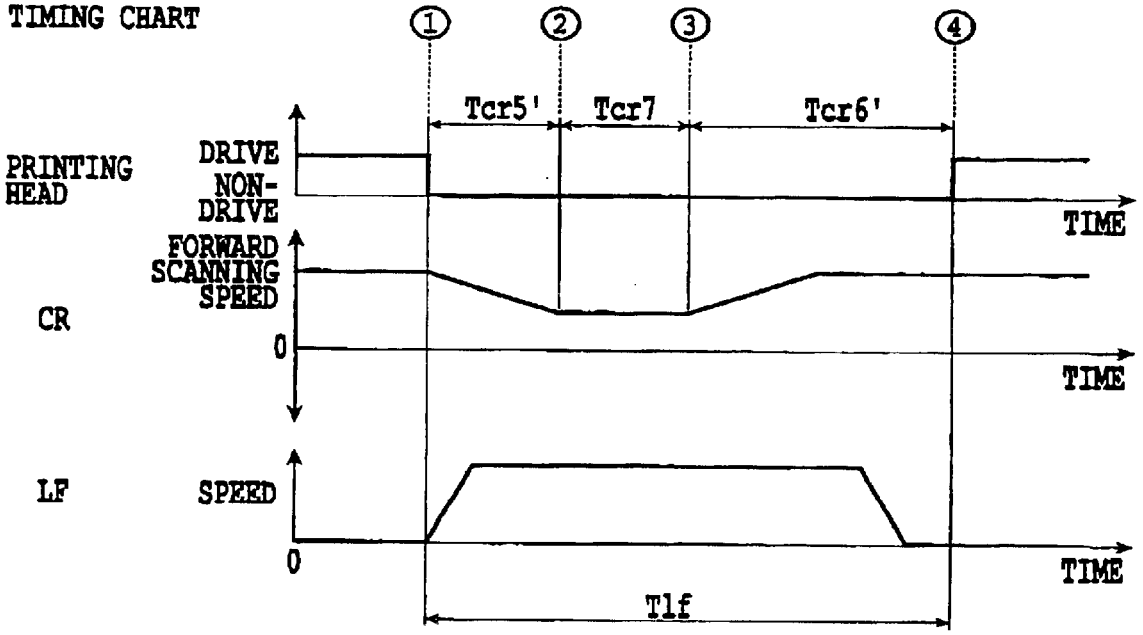
FIG. 7B is a timing chart showing operations of respective driving portions after printing for the first line of the printing pattern of FIG. 7A to starting printing for the second line.

FIG. 7B is a timing chart of the case where the carriage is not stopped in the pattern 4.

After completion of printing of the first line (point ① of FIG. 7B,) a period Tcr5' required for decelerating the carriage to a predetermined speed and a period Tcr6' required for accelerating the carriage from the predetermined low speed to the normal carriage scanning speed and reaching the second line printing start position (point F of FIG. 7A) are calculated. Then, a low speed scanning period Tcr7 of the carriage is determined so that T1f<Tcrf5'+Tcr6'+Tcr7 is established. Thus, the carriage can reach the print start portion of the second line without stopping the carriage.

In the conventional method, irrespective of the printing pattern, an equal period has been required from completion of printing of one line to transition to printing of the next line. However, by controlling the driving and the stopping of the carriage depending upon the printing pattern as in the shown embodiment, it becomes possible to shorten a period from stopping of feeding of the printing medium to starting of printing of the next line and to achieve efficient carriage travel and printing medium feeding.

It should be noted that when the interval of the printing positions of the first line and the second line in width direction is smaller than the distance necessary for deceleration, stop and acceleration of the carriage, the carriage has to be driven in a reverse direction even when the printing pattern is the patterns 3 and 4. This method is similar to the conventional method to minimize scanning of the carriage depending upon the printing pattern.

(Second Embodiment)

The first embodiment has been discussed in terms of the printer having capability of bi-directional printing. In bi-directional printing, an error of printing position may be caused between the line printed by the forward scan and the line printed by the reverse scan, or to cause a phase error in reverse scan due to vibration during scanning of the carriage, to cause fluctuation of image quality or the like. Accordingly, in order to improve the image quality, it has been spreading printing method to make the scanning in the same direction when the printing patterns are located adjacent with each other in the feeding direction of the printing medium. In the alternative, printers of uni-directional printing, in which scanning direction is constantly one direction, have also been spreading. In the shown embodiment, the carriage drive controlling depends upon the printing pattern in the case where the printing is performed by scanning the carriage in the same direction.

Figure 8A:
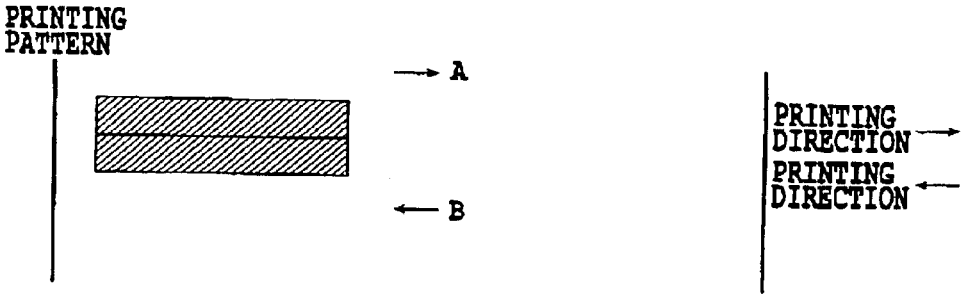
FIG. 8A is a diagrammatic chart showing a printing pattern in the second embodiment.

FIG. 8A is the shown embodiment of a printing pattern.

Figure 8B:
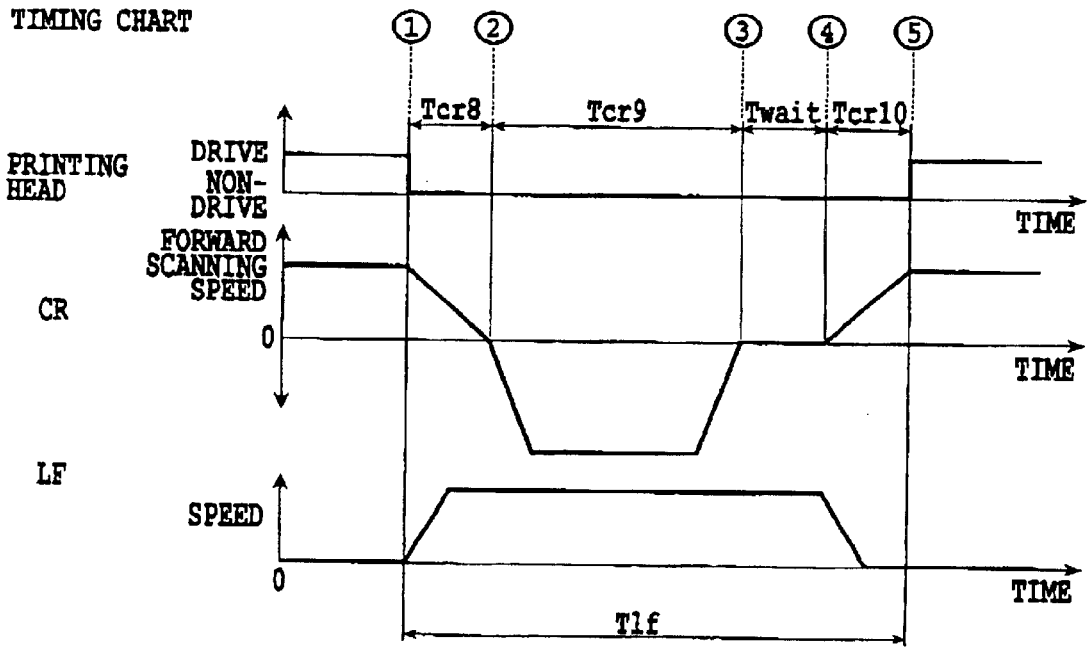
FIG. 8B is a timing chart showing operations of respective driving portions after printing for the first line of the printing pattern of FIG. 8A to starting printing for the second line.

FIG. 8B is a timing chart of a respective driving portion upon transfer from the first line to the second line of the foregoing printing pattern.

When printing of the first line is completed (point ① of FIG. 8B), the feeding motor is driven to feed the printing medium a predetermined amount. A period required for feeding the printing medium for a predetermined amount is assumed to be T1f. This is the same as the first embodiment.

Upon completion of printing of the first line, the carriage is decelerated in travel in the direction A and stopped (point ② of FIG. 8B). This deceleration and stop period is assumed to be Tcr8.

The carriage turns the scanning direction to the direction B for scanning in reverse direction to return to the predetermined position (from point ② to point ③ of FIG. 8B). Since this reverse travel is travel not relating to printing, the carriage often travels at a higher speed than the carriage speed in a normal printing, and is referred to as a carriage return. A period required for reverse travel, namely a return period is assumed to be Tcr9.

In order to reach the printing start position of the second line at a predetermined speed, the carriage starts acceleration from an acceleration start position (point ④ of FIG. 8B) to reach the printing start position at the predetermined speed upon initiation of the driving of the printing head (point ⑤ of FIG. 8B). This acceleration period is assumed to be Tcr10.

In order to simultaneously complete reaching of the predetermined speed of the carriage and completion of feeding of the printing medium at the point A, the waiting period Twait is provided in order to match the scanning of the carriage to feeding of the printing medium, in a manner similar to the first embodiment. This Twait is derived in the following manner.

At first, Tcr8, Tcr9, Tcr10, and T1f are calculated depending upon the performances of the feeding motor and the carriage motor and the printing medium feeding amount depending upon the printing pattern. Then, when T1f>Tcr8+Tcr9+Tcr10, the waiting period is calculated by Twait=T1f−(Tcr8+Tcr9+Tcr10), and when T1f≦Tcr8+Tcr9+TCr10, Twait=0 is set.

Namely, when the printing medium feeding period T1f is shorter than the carriage scanning period (Tcr8+Tcr9+Tcr10) from completion of printing of the first line to printing start of the second line, the carriage is driven without the waiting period. On the other hand, when the printing medium feeding period T1f is longer than the carriage scanning period (Tcr8+Tcr9+TCr10) from completion of printing of the first line to printing start of the second line, the waiting period Twait is provided between carriage travels for the first and second lines, thereby being able to instantly start printing of the second line at the timing of completion of feeding of the printing medium. Accordingly, irrespective of the printing pattern, printing can be performed at minimum period.

(Third Embodiment)

When the printing head is an ink-jet printing type, by repeated ejecting operation, viscosity of the ink around the ejection opening is increased to cause variation of the condition of the ejection opening to affect for hitting position of the ink droplet. Therefore, the recovery process is regularly performed during the printing operation. The most typical recovery process is the "preparatory ejection process" to move the printing head to a position out of the printing region, such as a home position or the like and to perform ejection in place. In the shown embodiment, application of the present invention for the printer performing preparatory ejecting process will be explained.

Figure 9A:
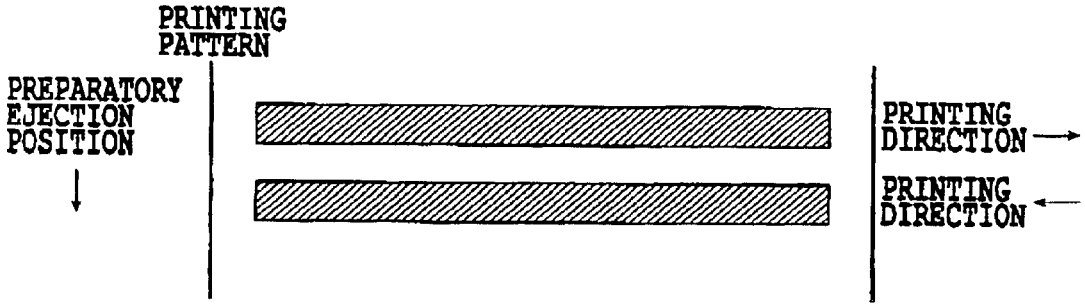
FIG. 9A is a diagrammatic chart showing a printing pattern in the third embodiment.

In the printing pattern shown in FIG. 9A, a preparatory ejection position is provided outside of the printing region to perform preparatory ejection when the printing head reaches the preparatory ejection position after completion of printing of the first line.

Figure 9B:
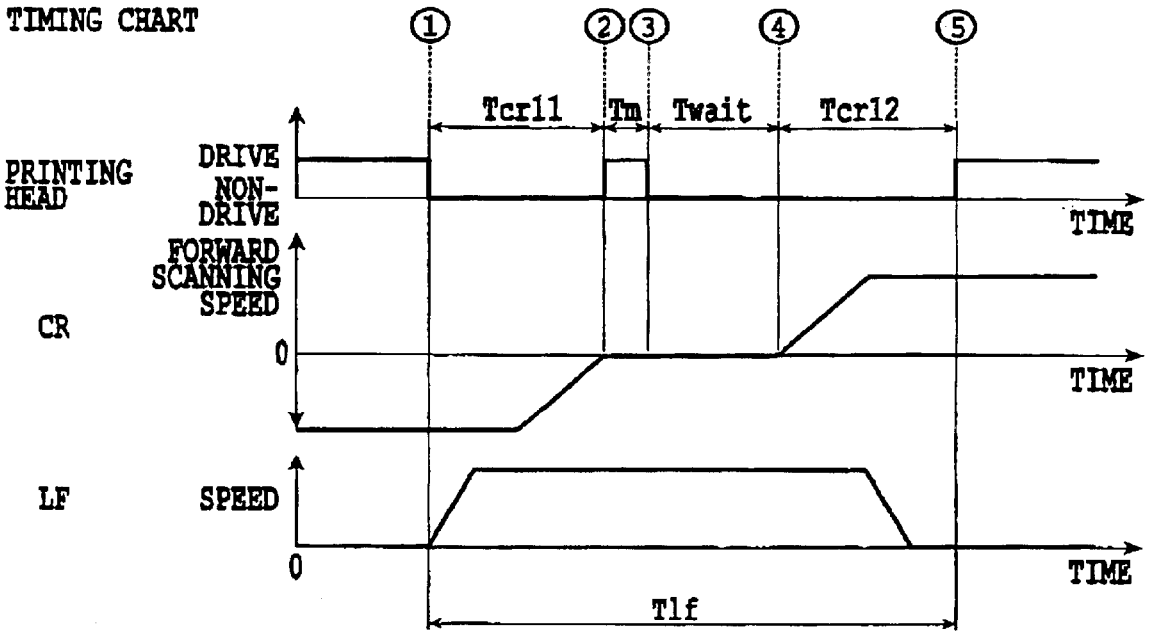
FIG. 9B is a timing chart showing operations of respective driving portions after printing for the first line of the printing pattern of FIG. 9A to starting printing for the second line.

FIG. 9B is a timing chart for printing of the printing pattern of FIG. 9A.

At a timing of completion of printing of the first line (point ① of FIG. 9B), the feeding motor initiates feeding of the printing medium for the predetermined amount. The period required for feeding the printing medium in the predetermined amount is assumed to be T1f. This is the same as the first embodiment.

Upon completion of printing of the first line, the carriage is moved, decelerated and stopped at the preparatory ejection position (point ② of FIG. 9B). The deceleration and stop period is assumed to be Tcr11.

When the carriage reaches the preparatory ejection position, the printing head performs preparatory ejection (from point ② to point ③ of FIG. 9B). The preparatory ejection period is assumed to be Tm.

When preparatory ejection is completed, the acceleration of the carriage is initiated so as to reach the printing start position of the second line at the predetermined speed (point ④ of FIG. 9B), to reach the printing start position at the predetermined speed upon driving of the printing head (point ⑤ of FIG. 9B). The acceleration period is assumed to be Tcr12. However, when acceleration is initiated immediately after finishing the preparatory ejection, it is possible to reach the printing start position before completion of feeding of the printing medium. Therefore, in a similar manner as to the first and second embodiments, the waiting period Twait is provided after finishing the preparatory ejection. The calculation of Twait is performed hereinafter.

Similar to the first and second embodiments, Tcr11, Tcr12, Tm and T1f are calculated depending upon the performances of the feeding motor and the carriage motor and the printing medium feeding amount depending upon the printing pattern. Then, if $T1f>Tcr11+Tcr12+Tm$, the waiting period is calculated by $Twait=T1f-(Tcr11+Tcr12+Tm)$. On the other hand, if $T1f\leqq Tcr11+Tcr12+Tm$, the waiting period Twait is set at $Twait=0$.

Namely, when the printing medium feeding period T1f is shorter than a sum of the carriage scanning period (Tcr11+Tcr12) from completion of printing of the first line to starting of printing of the second line and the preparatory ejection period Tm, the carriage is driven to travel without the waiting period. On the other hand, when the T1f is longer than the sum, the waiting period of the carriage is provided so that printing can be initiated immediately after finishing the feeding of the printing medium. Accordingly, even when the recovery process of the printing head, such as preparatory printing, is performed, printing can be performed at the shortest period.

Figure 10A:
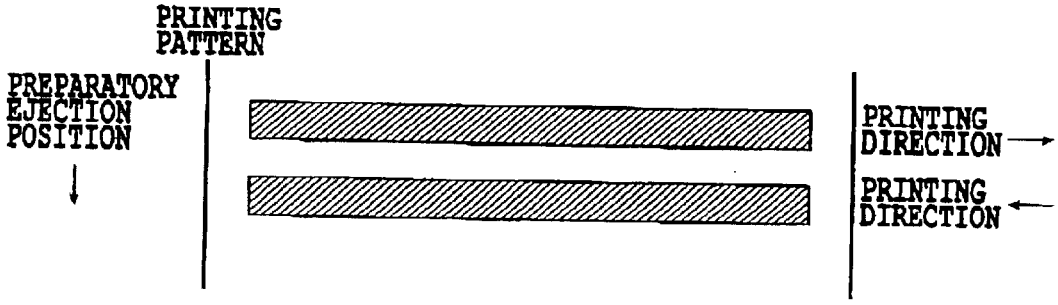
FIG. 10A is a diagrammatic chart showing a printing pattern in the third embodiment.
Figure 10B:
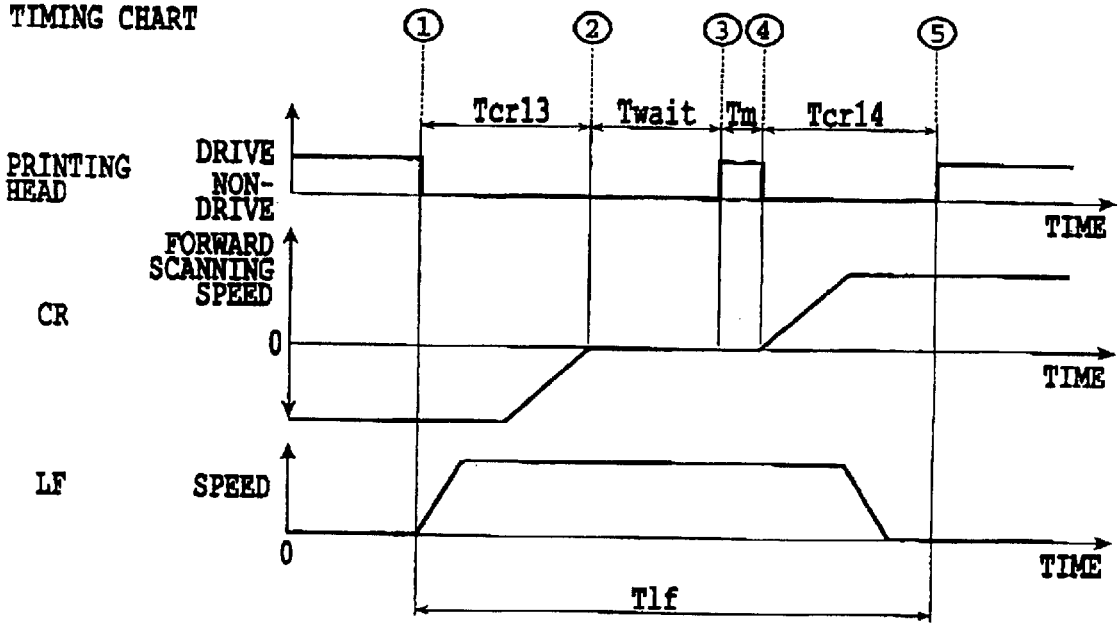
FIG. 10B is a timing chart showing operations of respective driving portions after printing for the first line of the printing pattern of FIG. 10A to starting printing for the second line.

On the other hand, in the same printing pattern shown in FIG. 10A, even in the mode where the order of the preparatory ejection and waiting is reversed, that is, when the carriage reaches the preparatory ejection position (point ② of FIG. 10B), the waiting period Twait is first provided without initiating preparatory ejection and the preparatory ejection is performed subsequently, a similar effect can be obtained.

In the embodiments shown in FIGS. 9A to 10B, after completion of printing of the first line, feeding of the printing medium is initiated depending upon the printing pattern and the carriage is simultaneously moved to the preparatory ejection position. At a timing of the preparatory ejection, when the printing completion position is close to the preparatory ejection position and the preparatory ejection position is located at the same direction as the scanning direction upon printing, wasteful carriage scanning can be eliminated. In the shown embodiment, after completion of printing of the first line, preparatory ejection is performed. Namely, after completion of printing of the odd number line, preparatory ejection is performed. It should be noted that the preparatory ejection position is not necessarily provided at one side but can be provided at both sides of the printing region.

A construction, in which the embodiments of FIGS. 9A to 10B and the embodiments of FIGS. 8A and 8B are combined, may also be established in accordance with the present invention.

As set forth above, by employing the printing apparatus and carriage scan controlling method according to the present invention, the carriage scanning period is set depending upon the printing completion position of the preceding line and the printing start position of the next line which are different per printing pattern, and the carriage control means controls scanning of the carriage so that the scanning of the carriage to printing start position of the next line after completion of printing of the preceding line and feeding of the printing medium in the predetermined amount are completed simultaneously. Therefore, printing can be performed at possible minimum period at respective printing pattern.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

What is claimed is:

1. A printing apparatus scanning a printing head over a printing medium a plurality of times, to perform printing upon the print medium during each respective scan and to feed the printing medium a predetermined amount in a direction different from a scanning direction of a carriage, said printhead being mounted on said carriage, said printing apparatus comprising:

means for getting information relating to a printing medium feeding period required for feeding the printing medium for the predetermined amount after completion of printing in a preceding line in a preceding scan;

means for setting a carriage scanning period required to start printing of the next line after completion of printing in said the preceding line so as to become equal to said printing medium feeding period depending upon a printing completion position of the preceding line and the printing start position of the next line; and means for driving said carriage to scan depending upon a period set by said carriage scanning period setting means.

2. A printing apparatus as claimed in claim 1, wherein said carriage scanning period includes at least a first carriage scanning period required for the carriage to reach a predetermined position after completion of printing of the preceding line and a second carriage scanning period required for the carriage to reach the predetermined period at the printing start position of the next line, said carriage scanning period setting means takes a difference between a said printing medium feeding period and a sum of said first carriage scanning period and said second carriage scanning period, as a waiting period when a sum of said first carriage scanning period and said second carriage scanning period is less than said printing medium feeding period, and said carriage driving means maintains stopping the carriage for said waiting period after deceleration and stopping of the carriage according to said first carriage scanning period after completion of printing of the preceding line.

3. A printing apparatus as claimed in claim 1, wherein said carriage scanning period includes at least a first carriage scanning period required for the carriage to reach a predetermined position after completion of printing of the preceding line and a second carriage scanning period required for the carriage to reach the predetermined period at the printing start position of the next line, said carriage scanning period setting means sets a scanning speed of said carriage so that a sum of said first carriage scanning period and said second carriage scanning period becomes equal to said printing medium feeding period, and said carriage driving means drives a carriage scanning depending upon the scanning speed of the carriage set by said carriage scanning period setting means.

4. A printing apparatus scanning a printing head over a printing medium a plurality of times, to perform printing upon the print medium during each respective scan and to feed the printing medium a predetermined amount in a direction different from a scanning direction of a carriage, said printhead being mounted on said carriage, said printing apparatus comprising:

means for getting information relating to a printing medium feeding period required for feeding the printing medium for the predetermined amount after completion of printing in a preceding line in a preceding scan;

means for getting information relating to a carriage scanning period from an end position of printing of the preceding line to a start position of printing of the next line in a scanning direction of the carriage; and means for driving said carriage to scan to start printing of the next line, after completion of printing in the preceding line, depending upon a relationship between said carriage scanning period and said printing medium feeding period, wherein said carriage driving means starts printing of said next line without stopping said carriage subsequent to the printing of said preceding line when said carriage scanning period is more than said printing medium feeding period and printing directions of the preceding line and the next line are of the same direction.

5. A printing apparatus as claimed in claim 4, wherein said carriage driving means does not vary a scanning speed of said carriage even after completion of printing of the preceding line when said carriage scanning period is longer than said printing medium feeding period.

6. A printing apparatus as claimed in claim 4, wherein said carriage driving means provides a zone to stop the carriage for a predetermined period so that said carriage scanning period becomes equal to said printing medium feeding period when said carriage scanning period is less than said printing medium feeding period, and accelerates said carriage to reach the printing start position at a predetermined speed after decelerating said carriage to stop for the predetermined period after completion of printing of the preceding line.

7. A printing apparatus as claimed in claim 4, wherein said carriage driving means provides a zone to decelerate the carriage for a predetermined period so that said carriage scanning period becomes equal to said printing medium feeding period when said carriage scanning period is less than said printing medium feeding period, and accelerates said carriage to reach the printing start position at a predetermined speed after scanning said carriage at a decelerated speed after completion of printing of the preceding line.

8. A printing apparatus scanning a printing head over a printing medium a plurality of times, to perform printing upon the print medium during each respective scan and to feed the printing medium a predetermined amount in a direction different from a scanning direction of a carriage, said printhead being mounted on said carriage, said printing apparatus comprising:

means for getting information relating to a printing medium feeding period required for feeding the printing medium for the predetermined amount after completion of printing in a preceding line in a preceding scan;

means for setting a carriage scanning period required to start printing of the next line after completion of printing in the preceding line in said preceding scan so as to become equal to said printing medium feeding period depending upon a printing completion position of the preceding line and the printing start position of the next line; and means for driving said carriage to scan depending upon a period set by said carriage scanning period setting means.

9. A printing apparatus as claimed in claim 8, wherein said carriage scanning period includes at least a first carriage scanning period required for stopping the carriage at a predetermined position after completion of printing of the preceding line, a carriage return period required for effecting a scanning in said predetermined direction and returning the carriage in reverse direction to stop at the predetermined position, and a second carriage scanning period required for the carriage to reach at the predetermined speed to the printing start position of the next line from a predetermined position stopping after carriage return, said carriage scanning period setting means takes a difference between a sum of said first carriage scanning period and said carriage return period and said second carriage scanning period, and a printing medium feeding period as a waiting period when a sum of said first carriage scanning period and said carriage return period and said second carriage scanning period is less than said printing medium feeding period, said carriage driving means maintains stopping the carriage for said waiting period after carriage return.

10. A printing apparatus scanning a printing head over a printing medium a plurality of times, to perform printing upon the print medium during each respective scan and to feed the printing medium a predetermined amount in a direction different from a scanning direction of a carriage, said printhead being mounted on said carriage, said printing apparatus comprising:

means for getting information relating to a printing medium feeding period required for feeding the printing medium for the predetermined amount after completion of printing in a preceding line in a preceding scan;

means for setting a carriage scanning period required to start printing of the next line after completion of printing in the preceding line in a preceding scan so as to become equal to said printing medium feeding period depending upon a printing completion position of the preceding line and the printing start position of the next line; and means for driving said carriage to scan depending upon a period set by said carriage scanning period setting means.

11. A printing apparatus as claimed in claim 10, wherein said carriage scanning period includes at least a first carriage scanning period required for the carriage to stop at a predetermined position after completion of printing in a predetermined direction, a recovery process period required for performing recovery process of the printing head at the predetermined position and a second carriage scanning period required for the carriage to reach the printing start position of the next line by scanning the carriage in a direction opposite to scanning of said predetermined direction from said predetermined position after finishing of the recovery process, said carriage scanning period setting means takes a difference between a sum of said first carriage scanning period, a recovery period and said second carriage scanning period, and said printing medium feeding period as a waiting period when a sum of said first carriage scanning period, said recovery period and said second carriage scanning period is less than said printing medium feeding period, said carriage driving means stops the carriage for said waiting period after finishing said recovery process.

12. A printing apparatus as claimed in claim 10, wherein said carriage scanning period includes at least a first carriage scanning period required for the carriage to stop at a predetermined position after completion of printing in a predetermined direction, a recovery process period required for performing recovery process of the printing head at the predetermined position and a second carriage scanning period required for the carriage to reach the printing start position of the next line by scanning the carriage in a direction opposite to scanning of said predetermined direction from said predetermined position after finishing of the recovery process, said carriage scanning period setting means takes said printing medium a difference between a sum of said first carriage scanning period, a recovery period and said second carriage scanning period, and said printing medium feeding period as a waiting period when a sum of said first carriage scanning period, said recovery period and said second carriage scanning period is less than said printing medium feeding period, said carriage driving means for performing said recovery process after stopping the carriage for said waiting period.

13. A carriage scan driving method using a printing apparatus scanning a printing head over a printing medium a plurality of times, to perform printing upon the print medium during each respective scan and to feed the printing medium a predetermined amount in a direction different from a scanning direction of a carriage, the carriage being used to mount the print head, said printing apparatus comprising:

a step of getting information relating to a printing medium feeding period required for feeding the printing medium for the predetermined amount after completion of printing in a preceding line in a preceding scan;

a step of setting a carriage scanning period required to start printing of the next line after completion of printing in the preceding line so as to become equal to the printing medium feeding period depending upon a printing completion position of the preceding line and the printing start position of the next line; and a step of driving the carriage to travel depending upon a period set in said carriage scanning period setting step.

14. A carriage scan driving method as claimed in claim 13, wherein the carriage scanning period includes at least a first carriage scanning period required for the carriage to reach a predetermined position after completion of printing of the preceding line and a second carriage scanning period required for the carriage to reach the predetermined period at the printing start position of the next line, said carriage scanning period setting step includes taking a difference between the printing medium feeding period and a sum of the first carriage scanning period and the second carriage scanning period, as a waiting period when a sum of the first carriage scanning period and the second carriage scanning period is less than the printing medium feeding period, and in said carriage driving step, the carriage is stopped for the waiting period after deceleration and stopping of the carriage according to the first carriage scanning period after completion of printing of the preceding line.

15. A carriage scan driving method as claimed in claim 13, wherein the carriage scanning period includes at least a first carriage scanning period required for the carriage to reach a predetermined position after completion of printing of the preceding line and a second carriage scanning period required for the carriage to reach the predetermined period at the printing start position of the next line, said carriage scanning period setting step includes setting a scanning speed of the carriage so that a sum of the first carriage scanning period and the second carriage scanning period becomes equal to the printing medium feeding period, and said carriage driving step includes controlling carriage scanning depending upon a scanning speed of the carriage set in said carriage scanning period setting step.

16. A carriage scan driving method using a printing apparatus scanning a printing head over a printing medium a plurality of times, to perform printing upon the print medium during each respective scan and to feed the printing medium a predetermined amount in a direction different from a scanning direction of a carriage, the carriage being used to mount the print head, said method comprising:

a step of getting information relating to a printing medium feeding period required for feeding the printing medium for the predetermined amount after completion of printing in a preceding line in a preceding scan;

a step of getting information relating to a scanning period of the carriage from completion position of printing of the preceding line to start position of printing of next line in a scanning direction of the carriage; and a step of driving the carriage to scan to start printing of the next line after completion of printing in the preceding line depending upon a relationship between the carriage scanning period and the printing medium feeding period, wherein, in said step of driving said carriage printing of the next line is begun without stopping the carriage subsequent to the printing of the preceding line when the carriage scanning period is more than the printing medium feeding period and printing directions of the preceding line and the next line are of the same direction.

17. A carriage scan driving method as claimed in claim 16, wherein, in said carriage driving step, a scanning speed of the carriage is not varied even after completion of printing of the preceding line when the carriage scanning period is longer than the printing medium feeding period.

18. A carriage scan driving method as claimed in claim 16, wherein said carriage driving step includes providing a zone to stop the carriage for a predetermined period so that the carriage scanning period becomes equal to the printing medium feeding period when the carriage scanning period is less than the printing medium feeding period, and includes accelerating the carriage to reach the printing start position at a predetermined speed after decelerating the carriage to stop for the predetermined period after completion of printing of the preceding line.

19. A carriage scan driving method as claimed in claim 16, wherein said carriage driving step includes providing a zone to decelerate the carriage for a predetermined period so that the carriage scanning period becomes equal to the printing medium feeding period when the carriage scanning period is less than the printing medium feeding period, and accelerating the carriage to reach the printing start position at a predetermined speed after scanning the carriage at decelerated speed after completion of printing of the preceding line.

20. A carriage scan driving method using a printing apparatus scanning a printing head over a printing medium a plurality of times, to perform printing upon the print medium during each respective scan and to feed the printing medium a predetermined amount in a direction different from a scanning direction of a carriage, the carriage being used to mount the print head, said method comprising:

a step of getting information relating to a printing medium feeding period required for feeding the printing medium for the predetermined amount after completion of printing in a preceding line in a preceding scan;

a step of setting a carriage scanning period required to start printing of the next line after completion of printing in the preceding line in the preceding scan so as to become equal to the printing medium feeding period depending upon a printing completion position of the preceding line and the printing start position of the next line; and a step of driving the carriage to scan depending upon a period set in said carriage scanning period setting step.

21. A carriage scan driving method as claimed in claim 20, wherein the carriage scanning period includes at least a first carriage scanning period required for stopping the carriage at a predetermined position after completion of printing of the preceding line, a carriage return period required for effecting scanning in the predetermined direction and returning the carriage in reverse direction to stop at the predetermined position, and a second carriage scanning period required for the carriage to reach at the predetermined speed to the printing start position of the next line from a predetermined position stopping after carriage return, said carriage scanning period setting step includes taking a difference between a sum of the first carriage scanning period and the carriage return period and the second carriage scanning period, and a printing medium feeding period as a waiting period when a sum of the first carriage scanning period and the carriage return period and the second carriage scanning period is less than the printing medium feeding period, and in said carriage driving step, the carriage is stopped for the waiting period after carriage return.

22. A carriage scan driving method using a printing apparatus scanning a printing head over a printing medium a plurality of times, to perform printing upon the print medium during each respective scan and to feed the printing medium a predetermined amount in a direction different from a scanning direction of a carriage the carriage being used to mount the print head, wherein a recovery process of the printing head at a predetermined position is performed per scan in a predetermined direction of said carriage, said method comprising:

a step of getting information relating to a printing medium feeding period required for feeding the printing medium for the predetermined amount after completion of printing in a preceding line in a preceding scan;

a step of setting a carriage scanning period required to start printing of the next line after completion of printing in the preceding line in a preceding scan so as to become equal to the printing medium feeding period depending upon a printing completion position of the preceding line and the printing start position of the next line; and a step of driving the carriage to scan depending upon a period set in said carriage scanning period setting step.

23. A carriage scan driving method as claimed in claim 22, wherein the carriage scanning period includes at least a first carriage scanning period required for the carriage to stop at a predetermined position after completion of printing in a predetermined direction, a recovery process period required for performing recovery process of the printing head at the predetermined position and a second carriage scanning period required for the carriage to reach the printing start position of the next line by scanning the carriage in a direction opposite to scanning of the predetermined direction from said predetermined position after finishing of the recovery process, said carriage scanning period setting step includes taking the printing medium a difference between a sum of the first carriage scanning period, a recovery period and the second carriage scanning period, and the printing medium feeding period as a waiting period when a sum of the first carriage scanning period, the recovery period and the second carriage scanning period is less than the printing medium feeding period, and in said carriage driving step, carriage is stopped for the waiting period after the recovery process.

24. A carriage scan driving method as claimed in claim 22, wherein the carriage scanning period includes at least a first carriage scanning period required for the carriage to stop at a predetermined position after completion of printing in a predetermined direction, a recovery process period required for performing recovery process of the printing head at the predetermined position and a second carriage scanning period required for the carriage to reach the printing start position of the next line by scanning the carriage in a direction opposite to a scanning of the predetermined direction from the predetermined position after finishing of the recovery process, said carriage scanning period setting step includes taking a difference between a sum of the first carriage scanning period, a recovery period and the second carriage scanning period, and the printing medium feeding period as a waiting period when a sum of the first carriage scanning period, the recovery period and the second carriage scanning period is less than the printing medium feeding period, said carriage driving step includes performing the recovery process after stopping the carriage for the waiting period.

25. A printing method performing printing on a printing medium with a primary scan of a printing head over a printing medium a plurality of times, and with an auxiliary scan of the printing medium and the carriage in a direction different from the direction of the primary scan, the method comprising:

a printing step, of performing printing in a leading primary scan;

a step of performing the auxiliary scan after completion of said printing step and before initiation of printing in a succeeding primary scan;

wherein a period required for the primary scan from a printing completion position of a printing step in a said leading primary scan to a printing start position of a printing step in a next primary scan is to become equal to a period required for the auxiliary scan.

* * * * *